US007388553B2

(12) United States Patent
Yuanzhu

(10) Patent No.: US 7,388,553 B2
(45) Date of Patent: Jun. 17, 2008

(54) ANTENNA DEVICE FOR VEHICLE

(75) Inventor: Dou Yuanzhu, Fukushima-ken (JP)

(73) Assignee: Alps Electric Co., Ltd, Tokyo (JP)

( * ) Notice: Subject to any disclaimer, the term of this patent is extended or adjusted under 35 U.S.C. 154(b) by 0 days.

(21) Appl. No.: 11/247,094

(22) Filed: Oct. 6, 2005

(65) Prior Publication Data

US 2006/0077113 A1 Apr. 13, 2006

(30) Foreign Application Priority Data

Oct. 12, 2004 (JP) ..... 2004-297736

(51) Int. Cl.
*H01Q 13/10* (2006.01)

(52) U.S. Cl. ..... 343/770

(58) Field of Classification Search ..... 343/770, 343/767, 700 MS, 702, 846–848
See application file for complete search history.

(56) References Cited

U.S. PATENT DOCUMENTS 5,912,647 A * 6/1999 Tsuru et al. ..... 343/700 MS
6,512,494 B1 * 1/2003 Diaz et al. ..... 343/909
6,741,214 B1 * 5/2004 Kadambi et al. .... 343/700 MS
2003/0174092 A1 * 9/2003 Sullivan et al. ..... 343/702
2003/0189522 A1 * 10/2003 Zeilinger ..... 343/702
2005/0122268 A1 * 6/2005 Suzuki ..... 343/702
2006/0012524 A1 * 1/2006 Mierke et al. ..... 343/700 MS

FOREIGN PATENT DOCUMENTS

JP 2003-218629 7/2003

* cited by examiner

*Primary Examiner*—Huedung Mancuso
(74) *Attorney, Agent, or Firm*—Brinks Hofer Gilson & Lione

(57) ABSTRACT

An antenna device includes a circuit board, an upper shield case, a lower shield case, and a power feeding member. The circuit board has high frequency circuits arranged thereon. The upper shield case and the lower shield case cover the circuit board. The power feeding member extends from an upper plate of the upper shield case. Radiation slots and are formed in the upper plate. The power feeding member includes a horizontal portion, a bent portion, and a drooping portion, and a front end of the drooping portion is mounted on a land of the circuit board and soldered thereto. The horizontal portion protrudes from a base end which is continuous to the upper plate in a horizontal direction. The bent portion is formed by bending a front end of the horizontal portion at a right angle. The drooping portion extends downward from the bent portion.

1 Claim, 2 Drawing Sheets

ANTENNA DEVICE FOR VEHICLE

BACKGROUND OF THE INVENTION

1. Field of the Invention

The present invention relates to an antenna device in which a slot antenna which excites a radiation slot formed in a metal plate and a circuit board having high frequency circuits connected to the slot antenna through a power feeding member are integrally formed, and more particularly, to a structure of the power feeding member.

2. Description of the Related Art

In this type of an antenna device, power feeding is implemented by forming a radiation slot in a metal case which covers a circuit board, thus allowing the case to function as a slot antenna. Therefore, the antenna device is suitable for a vehicle because miniaturization and cost reduction can be easily achieved.

FIG. 5 is a perspective view of a slot antenna according to the related art (for example, see JP-A-2003-218629 (page 2, FIG. 5). This slot antenna is constructed such that a radiation slot 2 is formed in an upper plate 1 a of a case member 1 made of a conductive metal plate so as to be excited. The radiation slot 2 is formed of an elongated aperture having a straight shape. Power feeding points 3 and 4 are set on the upper plate 1*a* at a substantially middle portion of the radiation slot 2. One of the power feeding points 3 and 4 is connected to a power feeding circuit, and the other is connected to a ground. While a power is being fed, a high frequency current flows along the periphery of the radiation slot 2, thus exciting the radiation slot 2 with a predetermined frequency.

In the slot antenna according to the above-described related art, the case member 1 can be used as a shield case which covers a circuit board (not shown) by disposing the upper plate 1 a above the circuit board having high frequency circuits such as a low noise amplification circuit. Thus, the power feeding points 3 and 4 are electrically connected to a land on the circuit board through a power feeding member such as a power feeding pin, so that a compact antenna device can be realized by making the slot antenna and the circuit board into one unit.

However, in the antenna device having the above-mentioned structure, in order to electrically connect the power feeding points 3 and 4 of the upper plate 1*a* to the land on the circuit board, the power feeding member should be soldered to each of the power feeding points 3 and 4. Thus, solder connection work is not only complicated but also may cause connection defects due to excessively strong stress applied on a soldered portion of the power feeding member when displacement is generated in a relative position between the upper plate 1*a* and the circuit board. In particular, when this type of an antenna device is mounted in a vehicle, displacement may easily occur in the relative position between the upper plate 1*a* and the circuit board due to thermal expansion which is caused by external vibration and temperature changes. Thus, for example, whenever the distance between the upper plate 1*a* and the circuit board increases and decreases, strong stress is applied on the soldered portion of the power feeding member, thus causing soldering crack to easily occur.

SUMMARY OF THE INVENTION

The present invention has been finalized in view of the drawbacks inherent in the antenna device according to the related art, and it is an object of the present invention to provide an antenna device which can prevent connection defects of a power feeding member, thus improving reliability.

In order to solve the above-mentioned problem, according to an aspect of the invention, an antenna device includes a circuit board on which high frequency circuits are disposed, a conductive metal plate which is disposed to face the circuit board and in which radiation slots are formed, and a power feeding member which is formed of a band-shaped metal piece extending from the metal plate and of which a front end thereof is soldered to the high frequency circuits. A hinge-shaped bent portion is formed between a base end and the front end of the power feeding member.

In this way, when the power feeding member is formed of a band-shaped metal piece extending from the metal plate in which the radiation slots are formed, and a hinge-shaped bent portion is formed in the power feeding member in advance, although displacement is generated in a relative position between the metal plate (the base end side of the power feeding member) and the circuit board (the front end side of the power feeding member) by external vibration and thermal expansion, the displacement can be absorbed by elasticity of the bent portion or the like. Thus, stress applied on the soldered portion of the front end of the power feeding member is decreased, thus preventing soldering cracks from being generated. In addition, since the base end side of the power feeding member is continuous to the metal plate, soldering is not required. Therefore, poor soldering connection of the power feeding member due to external vibration and thermal expansion can be effectively prevented. Thus, assembly efficiency can be improved because soldering connection work in the power feeding member can be made simple.

In the antenna device having the above-mentioned structure, for example, a portion extending from the base end of the power feeding member to the bent portion thereof is formed of a horizontal portion which extends along a bent line or a curved line which is substantially parallel to the circuit board. Further, a portion extending from the bent portion of the power feeding member to the front end thereof is formed of a drooping portion which extends along a line which is substantially vertical to the circuit board. In this case, if a thickwise direction of the drooping portion is set as an X direction, a direction which is parallel to the circuit board and orthogonal to the X direction is set as a Y direction, and a direction vertical to the circuit board is set as a Z-direction since the power feeding member has sufficient elasticity with respect to external force opening and closing the hinge-shaped bent portion. Displacement is generated in a relative position between the base end and the front end of the power feeding member in the X direction or the Z direction, the power feeding member easily responds to the displacement. Further, with respect to displacement in the Y-direction, the power feeding member can correspond to the displacement by using torsion of the horizontal portion which extends along the bent line or the curved line. Therefore, although displacement is generated in the relative position between the base end and the front end of the power feeding member in any of the X, Y, and Z directions by external vibration and thermal expansion, stress applied on a soldered portion of the power feeding member can be decreased.

In addition, in the antenna device having the above-mentioned structure, when the metal plate is an upper plate of a shield case which covers the circuit board, the number of components and assembly processes can be decreased because a slot antenna also serves as a shield case, thereby obtaining a small-sized and inexpensive antenna device. In this case, before a reflow soldering process of mounting various chip components constituting high frequency circuits on the circuit board, the shield case is mounted on the circuit board such that the front end of the power feeding member is mounted on cream solder of a land. Thus, complex soldering connection work is not required for the power feeding member because the power feeding member can be collectively subjected to reflow soldering together with the various chip components.

DESCRIPTION OF THE PREFERRED EMBODIMENT

Figure 1:
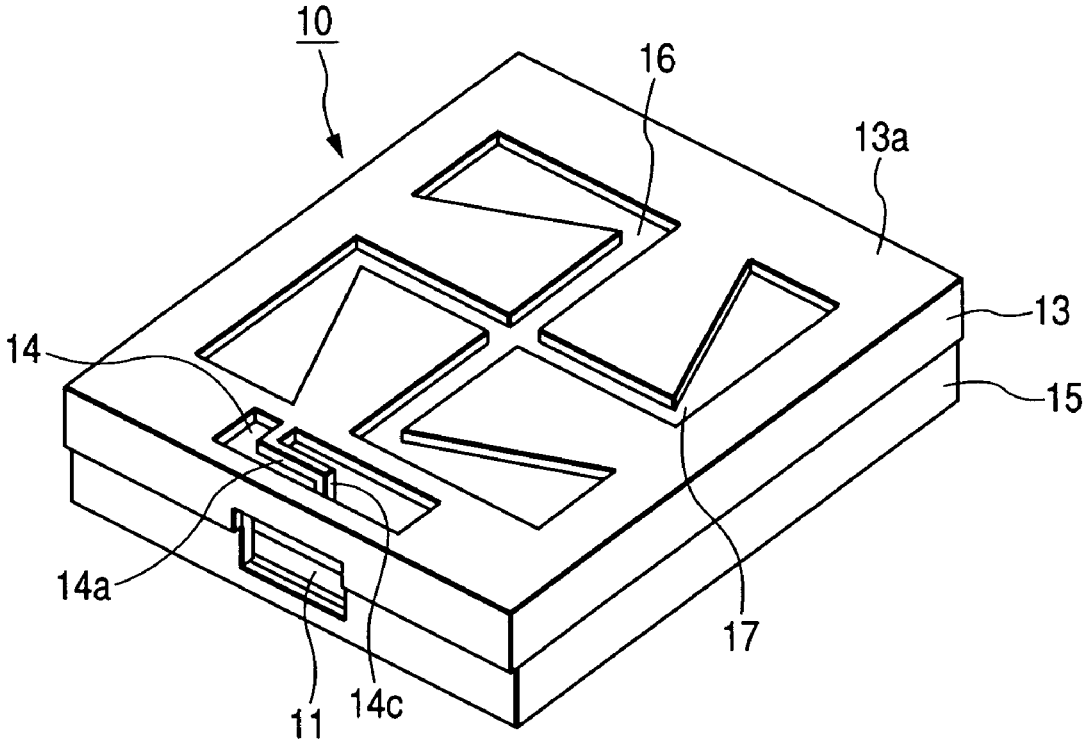
FIG. 1 is a perspective view of an antenna device according to an embodiment of the invention.
Figure 2:
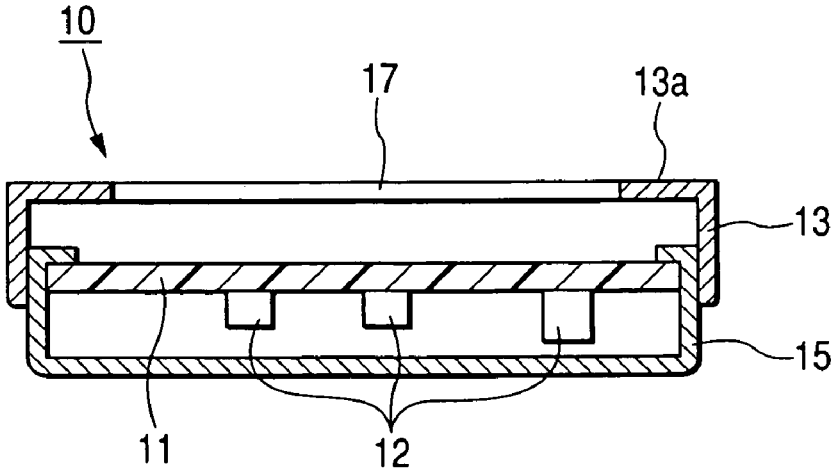
FIG. 2 is a cross-sectional view of the antenna device according to the embodiment of the invention.
Figure 3:
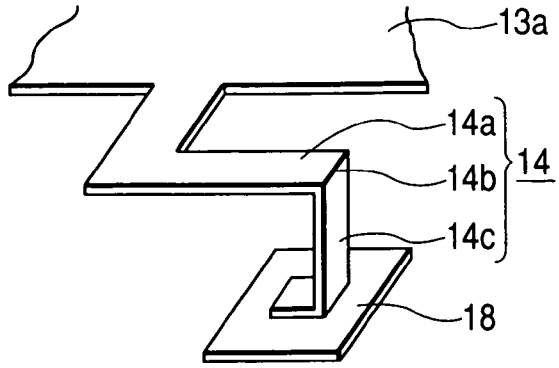
FIG. 3 is a perspective view of a power feeding member of the antenna device according to the embodiment of the invention.

Hereinafter, an embodiment of the invention will be described with reference to the accompanying drawings. FIG. 1 is a perspective view of an antenna device according to the embodiment of the invention. FIG. 2 is a cross-sectional view of the antenna device according to the embodiment of the invention. FIG. 3 is a perspective view of a power feeding member of the antenna device according to the embodiment of the invention.

An antenna device 10 shown in FIGS. 1 and 2 mainly includes a circuit board 11, an electronic component 12, an upper shield case 13 made of a metal plate, a power feeding member 14, and a lower shield case 15 made of a metal plate. The circuit board 11 has high frequency circuits arranged thereon. The electronic component 12 is mounted on the circuit board 11. The upper shield case 13 covers an upper surface of the circuit board 11. The power feeding member 14 extending from the upper shield case 13 is a metal piece formed in a band shape, and has its front end soldered to the high frequency circuit. The lower shield case 15 covers a lower surface of the circuit board 11. Radiation slots 16 and 17 are symmetrically formed with respect to a point on the upper plate 13*a* of the upper shield case 13, and they are formed in a Z shape in plan view.

The power feeding member 14 is formed by bending a portion of the pressed upper shield case 13, and has an appearance shown in FIG. 3. That is, the power feeding member 14 includes a horizontal portion 14*a*, a bent portion 14*b*, and a drooping portion 14*c*, and a front end of the drooping portion 14*c* is mounted on a land 18 of the circuit board 11 and soldered thereon. The horizontal portion 14*a* protrudes from a base end which is continuous to the upper plate 13*a* in a horizontal direction and extends in an L shape. The hinge-shaped bent portion 14*b* is formed by bending a front end of the horizontal portion 14*a* at a right angle. The drooping portion 14*c* extends downward from the bent portion 14*b*. Accordingly, since the upper plate 13*a* is electrically connected to high frequency circuits of the circuit board 11 through the power feeding member 14, the radiation slots 16 and 17 are excited so as to function as slot antennas. Further, in the present embodiment, by properly positioning the base end of the power feeding member 14 with respect to each of the radiation slots 16 and 17, the radiation slots 16 and 17 are excited with a phase difference of about 90 degrees so as to function as a circularly polarized wave antenna.

In this way, the antenna device 10 has a band-shaped metal piece serving as the power feeding member 14, and the band-shaped metal piece extends from the upper plate 13*a* in which the radiation slots 16 and 17 are formed. In the power feeding member 14, the horizontal portion 14*a* which is substantially parallel to the circuit boards 11 connected to the drooping portion 14*c* which is substantially vertical to the circuit board 11 at the bent portion 14*b* such that a connecting portion between them is formed in a hinge shape. Thus, although displacement is generated in a relative position between the upper plate 13*a* (the base end side of the power feeding member 14) and the circuit board 11 (the front end side of the power feeding member 14) by external vibration and thermal expansion, the displacement can be absorbed by elasticity of the bent portion 14*b* or the like.

That is, assume that a thickwise direction of the drooping portion 14*c* is set as an X direction, a direction which is parallel to the circuit board 11 and orthogonal to the X direction is set as a Y direction, and a direction vertical to the circuit board 11 is set as a Z direction. Because the power feeding member 14 has sufficient elasticity with respect to an external force opening and closing the bent portion 14*b*, even though the displacement is generated in a relative position between the base end and the front end of the power feeding member 14 in the X or Z direction, the power feeding member 14 easily responds to the displacement. Further, with respect to displacement in the Y direction, the power feeding member 14 can respond to the displacement by using torsion of the horizontal portion 14*a*. Therefore, although displacement is generated in the relative position between the base end and the front end of the power feeding member 14 in any of the X, Y, and Z directions by external vibration and thermal expansion, stress applied on a soldered portion located at the front end side of the power feeding member 14 can be decreased, thus preventing soldering cracks or the like from being generated. In addition, since the base end side of the power feeding member 14 is continuous to the upper plate 13*a*, soldering does not need to be performed to the continuous portion. For this reason, the antenna device 10 can effectively prevent poor soldering connection of the power feeding member 14 due to external vibration and thermal expansion, thus improving reliability.

In addition, in this antenna device 10, the upper shield case 13 functions as a slot antenna. Thus, the number of components and assembly processes can be decreased, and miniaturization and cost reduction can be easily enhanced. Assembly efficiency can be further improved by the following method. Before a reflow soldering process for mounting various chip components constituting high frequency circuits on the circuit board 11, the upper shield case 13 is mounted on the circuit board 11 such that the front end of the power feeding member 14 is mounted on cream solder of the land 18. Thus, complex soldering connection work is not required for the power feeding member 14 because the power feeding member 14 can be collectively subjected to reflow soldering together with the various chip components, which further improves assembly efficiency.

Further, in the above-described embodiment, although the horizontal portion 14*a* of the power feeding member 14 extends along a bent line formed in an L-shape which is substantially parallel to the circuit board 11, the horizontal portion 14*a* may extend along a curved line which is substantially parallel to the circuit board 11. Furthermore, the circularly polarized wave slot antenna in which a pair of the radiation slots 16 and 17 are formed has been described. However, the present invention relates to the structure of a power feeding member, and the invention may be applied to a linearly polarized wave slot antenna.

Figure 4:
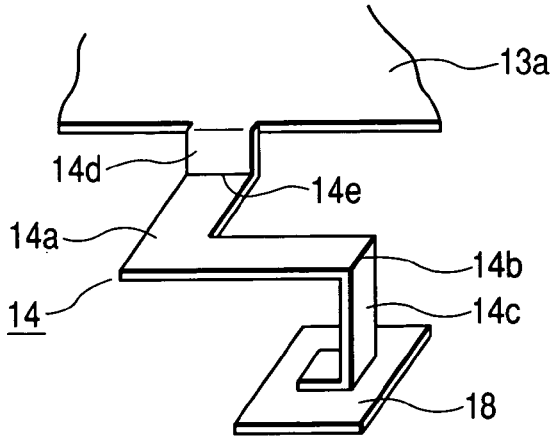
FIG. 4 is a perspective view of a power feeding member of an antenna device according to another embodiment of the invention.
Figure 5:
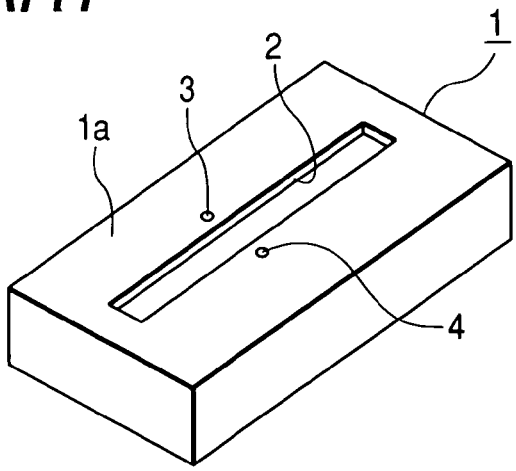
FIG. 5 PRIOR ART
FIG. 5 is a perspective view of a slot antenna according to the related art.

FIG. 4 is a perspective view of essential parts showing a power feeding member of an antenna device according to another embodiment of the invention. In FIG. 4, constituent elements corresponding to those of FIG. 3 are denoted by the same reference numerals.

The power feeding member 14 shown in FIG. 4 has a different shape of a base end from that of the above-described embodiment. The power feeding member 14 includes a second drooping portion 14*d*, a second bent portion 14*e*, a horizontal portion 14*a*, a bent portion 14*b*, and a drooping portion 14*c*. The second drooping portion 14*d* protrudes downward from the base end which is continuous to the upper plate 13*a*. The second bent portion 14*e* is formed by bending a front end of the second drooping portion 14*d* at a right angle. The horizontal portion 14*a* protrudes from the second bent portion 14*e* in a horizontal direction so as to extend in a substantially L shape. The bent portion 14*b* is formed by bending the front end of the horizontal portion 14*a* at a right angle. The drooping portion 14*c* extends downward from the bent portion 14*b*. In this way, when the second drooping portion 14*d* and the second bent portion 14*e* are additionally provided in the power feeding member 14, although displacement is generated in a relative position between the base end and the front end of the power feeding member 14 on a plane parallel to the circuit board 11, the displacement is reliably absorbed by the elasticity of the bent portion 14*b* and the elasticity of the second bent portion 14*e*. Therefore, poor soldering connection of the power feeding member 14 due to external vibration and thermal expansion can be more effectively prevented.

The antenna device of the invention is constructed such that the power feeding member is formed by extending the band-shaped metal piece having a hinge-shaped bent portion from the metal plate in which the radiation slots are formed, and the front end of the power feeding member is soldered to the land of the circuit board. Thus, although displacement is generated in a relative position between the slot antenna and the circuit board by external vibration and thermal expansion, the displacement can be absorbed by elasticity of the bent portion or the like, thereby decreasing the stress applied on the soldered portion of the power feeding member. For this reason, poor soldering connection of the power feeding member can be effectively prevented, so that reliability can be improved. In addition, assembly efficiency can be improved because soldering connection work in the power feeding member can be made simple.

The invention claimed is:

1. An antenna device comprising:

a circuit board on which high frequency circuits are disposed;

a conductive metal plate which is disposed to face the circuit board and in which radiation slots are formed; and a power feeding member which is formed of a band-shaped metal piece extending from the metal plate and of which a front end is soldered to the high frequency circuits;

wherein the power feeding member comprises a first planar portion that is disposed on a plane between the circuit board and the conductive metal plate, the first portion being substantially parallel to the circuit board and the conductive metal plate, and wherein a first vertical portion connects one end of the first planar portion to the metal plate and a second vertical portion connects the other end of the first planar portion to at least one high frequency circuit wherein the antenna device is mounted in a vehicle.

* * * * *